US010183301B2

(12) United States Patent
Orlans et al.

(10) Patent No.: US 10,183,301 B2
(45) Date of Patent: Jan. 22, 2019

(54) SPRAYER

(71) Applicant: NAANDANJAIN IRRIGATION LTD., Kibbutz Na'an (IL)

(72) Inventors: Yitzhak Orlans, Tel Aviv (IL); Tzafrir Kenyan, Kibbutz Malkia (IL)

(73) Assignee: NAANDANJAIN IRRIGATION LTD., Kibbutz Na'an (IL)

( * ) Notice: Subject to any disclaimer, the term of this patent is extended or adjusted under 35 U.S.C. 154(b) by 0 days.

(21) Appl. No.: 14/905,231

(22) PCT Filed: Jul. 13, 2014

(86) PCT No.: PCT/IL2014/050633
§ 371 (c)(1),
(2) Date: Jan. 14, 2016

(87) PCT Pub. No.: WO2015/008278
PCT Pub. Date: Jan. 22, 2015

(65) Prior Publication Data

US 2016/0151795 A1 Jun. 2, 2016

(30) Foreign Application Priority Data

Jul. 14, 2013 (IL) ..... 227462

(51) Int. Cl.
*B05B 1/30* (2006.01)
*B05B 3/04* (2006.01)
(Continued)

(52) U.S. Cl.
CPC ..... *B05B 1/308* (2013.01); *B05B 1/267* (2013.01); *B05B 1/3006* (2013.01); *B05B 1/323* (2013.01); *B05B 3/0486* (2013.01)

(58) Field of Classification Search
CPC ..... B05B 1/308; B05B 1/267; B05B 1/3006; B05B 1/323; B05B 3/0486
(Continued)

(56) References Cited

U.S. PATENT DOCUMENTS 2,975,981 A * 3/1961 Cockman ..... B05B 1/267 239/204
3,309,025 A * 3/1967 Malcolm ..... B05B 3/0472 239/230
(Continued)

OTHER PUBLICATIONS

International Search Report and Written Opinion for International Application No. PCT/IL2014/050633 dated Nov. 18, 2014.

*Primary Examiner* — Chee-Chong Lee
(74) *Attorney, Agent, or Firm* — Kaplan Breyer Schwarz, LLP

(57) ABSTRACT

According to the present application there is provided a sprayer comprising a housing having a fluid inlet configured for being statically coupled to a fluid source to receive fluid therefrom. The housing further comprises a fluid outlet configured for the discharging the fluid, the distance between the fluid inlet and the fluid outlet being fixed; The sprayer has a bridge mounted over the housing and comprising a dispersion element configured for dispersing fluid discharged from the fluid outlet of the housing; The bridge is configured for displacement over the housing at least between a closed position in which the dispersion element comes into contact with the fluid outlet to thereby seal it, and an open position in which the dispersion element is spaced from the fluid outlet by a gap, allowing dispersion of the fluid.

19 Claims, 16 Drawing Sheets

(51) Int. Cl.
*B05B 1/32* (2006.01)
*B05B 1/26* (2006.01)

(58) Field of Classification Search
USPC ..... 239/518
See application file for complete search history.

(56) References Cited

U.S. PATENT DOCUMENTS 3,432,102 A * 3/1969 Turner et al. ..... B05B 1/08
137/835
4,121,769 A * 10/1978 Drori ..... B05B 3/0486
239/222.17
4,177,944 A * 12/1979 Wichman ..... B05B 3/0472
239/230
4,231,521 A * 11/1980 Hermine ..... B05B 3/0472
239/228
4,369,922 A * 1/1983 Vikre ..... A01G 25/092
138/46
4,538,689 A * 9/1985 Dietrich, Sr. ..... A01B 21/086
172/700
4,817,869 A * 4/1989 Rubinstein ..... B05B 15/10
239/222.17

* cited by examiner

SPRAYER

RELATED APPLICATIONS

This Application is a 35 U.S.C. § 371 National Stage filing of International Application No. PCT/IL2014/050633, filed on Jul. 13, 2014, which claims benefit of and priority to Israeli Patent Application No. 227462, filed on Jul. 14, 2013. The contents of each of the above applications are hereby incorporated by reference in their entirety.

TECHNOLOGICAL FIELD

The subject matter of the present application refers to sprayers, in particular, sprayers of a pop-up configuration having a protective fluid outlet cover.

BACKGROUND

Micro-irrigation is a known method in which distributors placed in predetermined areas of a cultivated surface and connected to a system of supply of water under pressure continuously or periodically bring irrigation water to said areas.

In particular, it is known to provide a micro-sprayer in which a jet of irrigation fluid, provided through an inlet of the sprayer, is emitted from an outlet thereof towards a dispersion element of a predetermined geometric shape configured for dispersing the directional jet into different directions, thereby providing the required irrigation fluid to the areas to be irrigated.

Examples of such sprayers are disclosed in U.S. Pat. No. 4,512,519 to the applicant, as well as in U.S. Pat. No. 4,121,769, U.S. Pat. No. 4,623,094 and in various products on the market such as Fan-Jet® (http://www.bowsmith-.com/).

In addition, it is known to provide irrigation emitters with protection against insects and dirt by providing the outlet of the irrigator with a protective sleeve. Examples of this are disclosed, for example, in U.S. Pat. No. 8,079,531 and U.S. Pat. No. 8,083,158 to the applicant, as well as in market products such as Fan-Jet Plus® (http://www.bowsmith.com/Catalogs/Fan-Jet%20Plus.pdf)

Acknowledgement of the above references herein is not to be inferred as meaning that these are in any way relevant to the patentability of the presently disclosed subject matter.

GENERAL DESCRIPTION

According to one aspect of the subject matter of the present application there is provided a sprayer comprising:

- a housing having a fluid inlet configured for being statically coupled to a fluid source to receive fluid therefrom and a fluid outlet configured for the discharging said fluid, the distance between said fluid inlet and said fluid outlet being fixed;
- a bridge mounted over the housing and comprising a dispersion element configured for dispersing fluid discharged from the fluid outlet of the housing;

wherein the bridge is configured for displacement over the housing at least between a closed position in which the dispersion element engages the fluid outlet to thereby seal it, and an open position in which the dispersion element is spaced from the fluid outlet by a predetermined operational gap, whereby fluid emitted from the fluid outlet is free to disperse.

In particular, the arrangement can be such that, in operation, the housing forms a unitary body in which the fluid outlet is stationary with respect to the fluid inlet. According to one example, the housing can be constituted by a single piece, e.g. injection molder article, having one end constituting the fluid inlet and an opposite end constituting the fluid outlet.

According to another example, the housing can be constituted by an assembly of two or more components. However, it should be noted in this respect that regardless of the existence of any moving components within the housing, the fluid outlet remains fixedly spaced from the fluid inlet.

The arrangement can be such that the bridge is constantly urged into the closed position and that displacement of the bridge from the closed position to the open position is facilitated by the pressure of fluid emitted through the fluid outlet. In other words, the pressure of the fluid is sufficient to overcome the biasing force of the bridge towards the closed position.

According to one example, the bridge can be biased towards the closed position by virtue of gravitational forces. In this case, in the open position, the bridge is elevated over the fluid outlet and is constantly urged to 'drop down' towards the fluid outlet. It should be noted that the sprayer is not limited to a perpendicular vertical orientation (i.e. the dispersion element being located directly above the fluid outlet) and can be tilted, as long as the vertical downwards vector is sufficient for biasing the bridge into the closed position. In this connection, it is appreciated that the greater the angle from the vertical position, the smaller the biasing force and correspondingly, the smaller the pressure required for bringing the bridge into the open position. One advantage of the above arrangement lies in the simplicity of the design and the elimination of additional biasing components.

According to another example, the sprayer can comprise a biasing arrangement configured for constantly urging the bridge into the closed position. One advantage of such an arrangement lies in the ability to position the sprayer at any orientation, regardless of gravitational forces. One example of a biasing arrangement can be a biasing spring.

Displacement of the bridge over the housing can be facilitated by guides formed in the housing and the bridge and configured to engage one another to determine a displacement path of the bridge.

According to one design example, the guides are generally straight/axial, whereby displacement of the bridge over the housing is performed in a linear manner. Alternatively, the guides can be of helical or spiral configuration, whereby displacement of the bridge over the housing entails both axial and rotational movement.

The bridge can comprise a mounting portion configured for being displaceably fitted over the housing and at least one arm articulating the dispersion element to the mounting portion.

The sprayer can comprise at least an open limiter configured for restricting displacement of the bridge over the housing beyond the open position, i.e. limiting the distance between the dispersion element and the fluid outlet so as not to exceed the operational gap. The open limiter can also prevent the bridge from disengaging from the housing due to sufficient displacement away from the fluid outlet.

In the closed position, the fluid outlet itself can serve as a closed limiter, preventing displacement of the bridge over the housing beyond the closed position. Alternatively, the sprayer can comprise a dedicated closed limiter configured for the above purpose.

The open and the closed limiter can be constituted by an engagement between the housing and the mounting portion of the bridge. In particular, one of the bridge and the housing can comprise a channel having a first end and a second end, and the other of the two can comprise a restricting member configured for being received within the channel and displace therein.

The arrangement can be such that limiting of the displacement at the open position is provided by engagement of the restricting member with the first end of the channel and limiting of the displacement at the closed position is provided by engagement of the restricting member with the second end of the channel.

In connection with the above, it is appreciated that the guides of the housing and mounting portion can also function as the closed/open limiters.

In addition, the bridge can be mounted over the housing by a snap-type arrangement, wherein said arrangement constitutes the top and bottom limiter. In particular, the bridge can comprise a sleeve configured for being mounted over the housing, said sleeve comprising at least one longitudinal recess configured for receiving therein a projection of the housing.

Displacement of the bridge over the housing can be restricted by a top and bottom ends of the longitudinal recess, configured for abutting the projection in the open/closed positions of the sprayer.

Furthermore, at least one of the top and bottom ends can be formed with a nook configured for receiving therein a wedge of the projection of the housing, configured for reducing the bridge's ability to perform a tilting motion about the longitudinal axis.

According to a particular example, housing can comprise a sleeve having an open end and a rim constituting the fluid outlet of the housing, and a nozzle having a nozzle outlet disposed at or below the level of the rim. Under this configuration, in the second position of the sprayer, the rim of the sleeve is sealed by the dispersing element while the nozzle is located within the sleeve.

In particular, the sleeve can have a diameter greater than that of the nozzle, thereby yielding an annular basin extending about the nozzle. In addition, the basin can have a bottom surface disposed below the level of the nozzle outlet, whereby dirt, mud and clogging material is accumulated within the basin, around the nozzle, without blocking the nozzle outlet.

The nozzle can be formed with a shaped opening through which irrigation fluid is configured for being discharged. In particular, the nozzle can comprise several segments between its inlet and outlet so that the diameter of the nozzle is gradually reduced towards the outlet, increasing pressure within the nozzle.

The sleeve can be provided with at least one drainage opening configured for draining outside the housing of material from the inside the basin. The arrangement can be such that the drainage opening is located below the level of the nozzle outlet, whereby clogging material (dirt, mud etc.) are prevented from blocking the nozzle outlet.

The dispersion element can be spaced from the mounting portion by virtue of at least one articulating arm having a first end associated with the mounting portion and another end associated with the fluid outlet.

The articulating arm can be formed with a dividing edge facing said fluid outlet so that in the open position, obstruction of the fluid emitted from the fluid outlet and dispersed by the dispersion element is minimal by the articulating arm. Specifically, a body of fluid discharged from the dispersion element can be divided into at least two sub-bodies when impinging on the dividing edge.

The sprayer can also comprise a Pressure Compensation Device (PCD) interposed between the fluid inlet and the fluid outlet and configured for regulating the fluid flow within the housing, maintaining a desired outlet pressure or a fixed flow rate, regardless of variations in the same at the inlet. Under the above arrangement, the housing can comprise an inlet member and an outlet member configured for attachment to one another, the former comprising the fluid inlet and the latter comprising the fluid outlet.

The arrangement can be such that the PCD is constituted by an end portion of each of the inlet member and outlet member and additional components (e.g. diaphragm) disposed therebetween.

In addition, the sprayer can further comprise a Compensation No Leaking (CNL) device configured for preventing leakage from the sprayer when the latter is not in its operational mode, i.e. when the bridge rests on the rim of the outlet. Such a CNL device can be incorporated in conjunction with the PCD and be interposed between the PCD and the outlet of the sprayer. According to a particular design, the CNL device can be configured for maintaining a closing pressure of 0.5 Bar.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
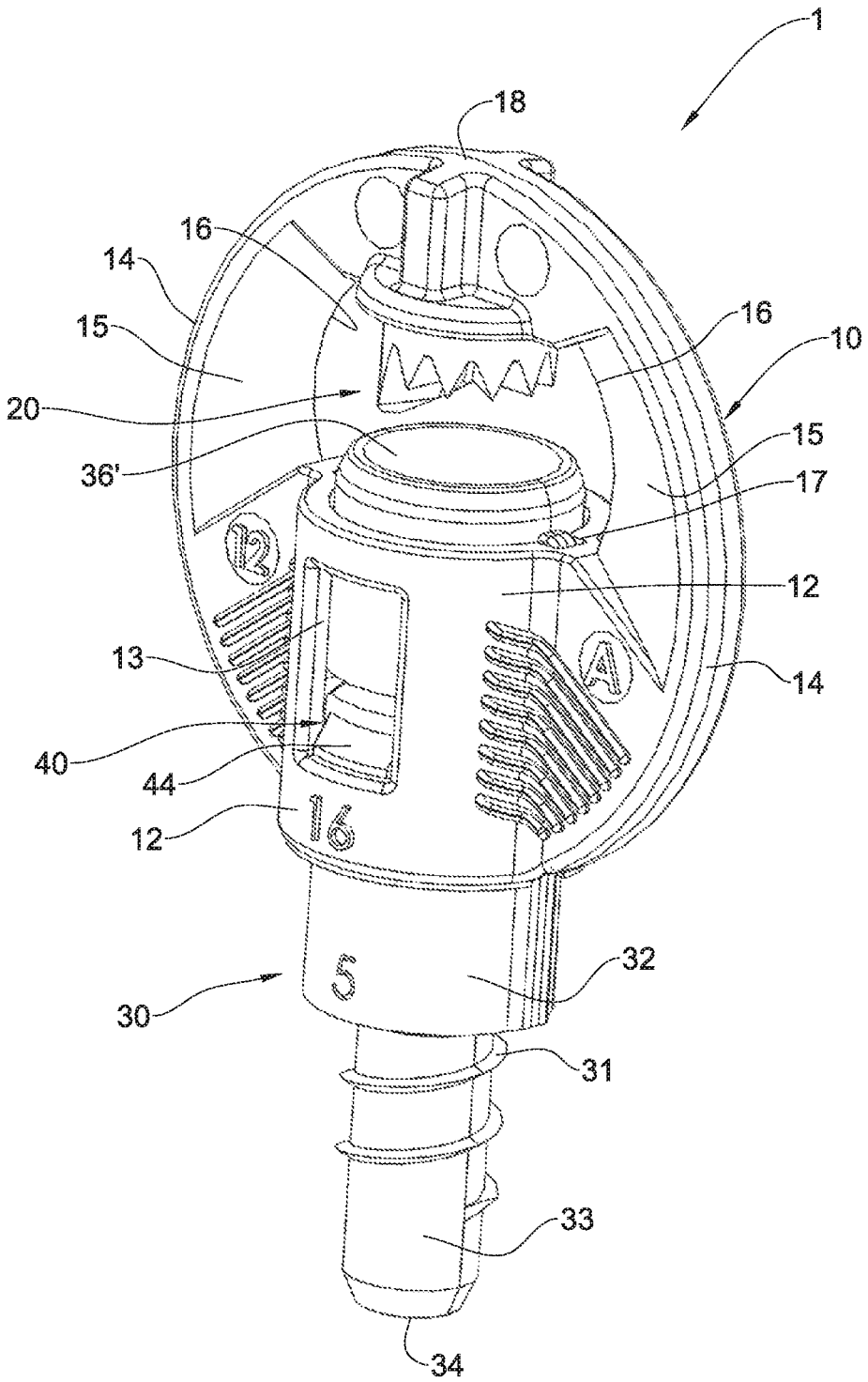
FIG. 1A is a schematic isometric view of a sprayer according to one example of the subject matter of the present application.
Figure 1B:
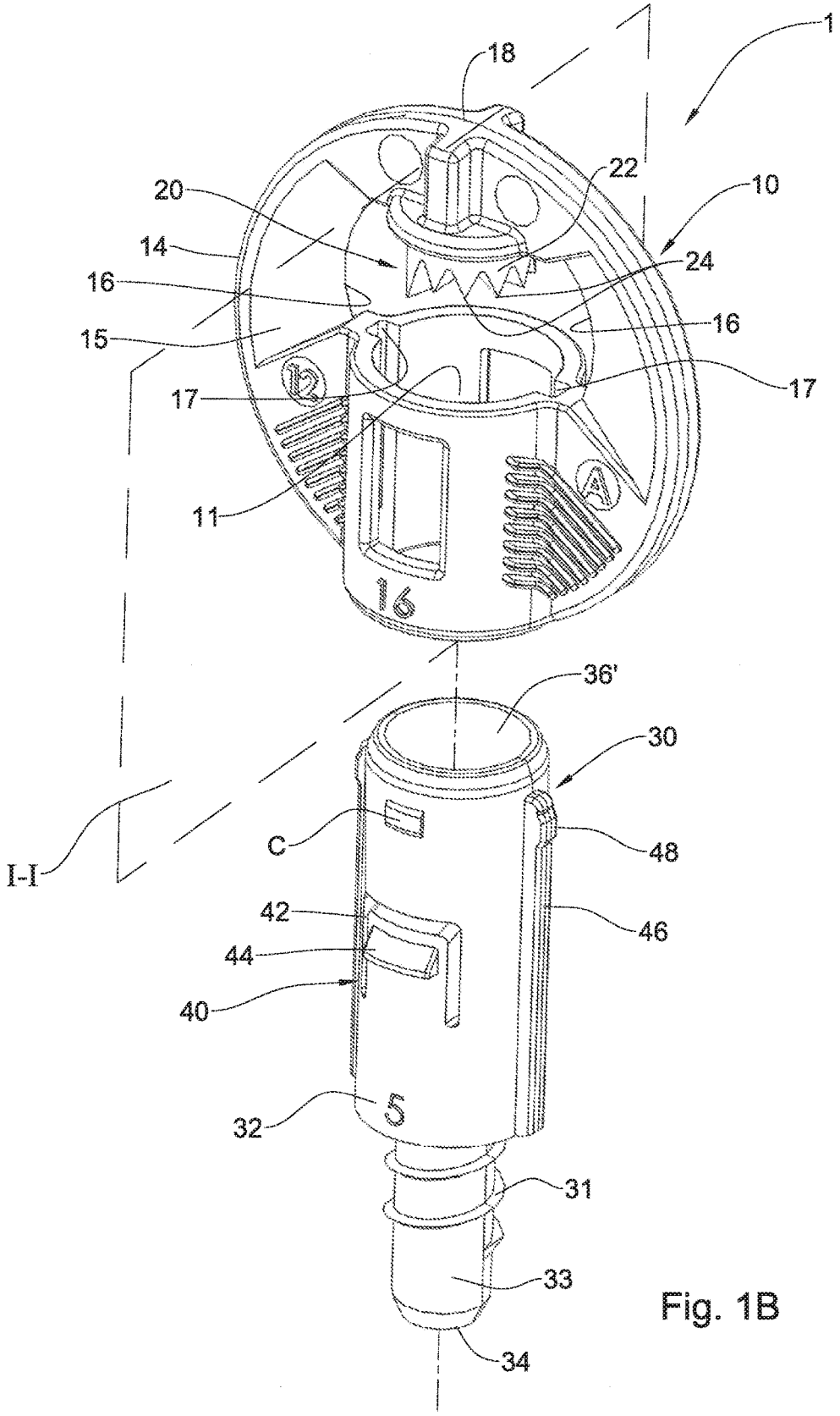
FIG. 1B is a schematic exploded isometric view of the sprayer shown in FIG. 1A.
Figure 2:
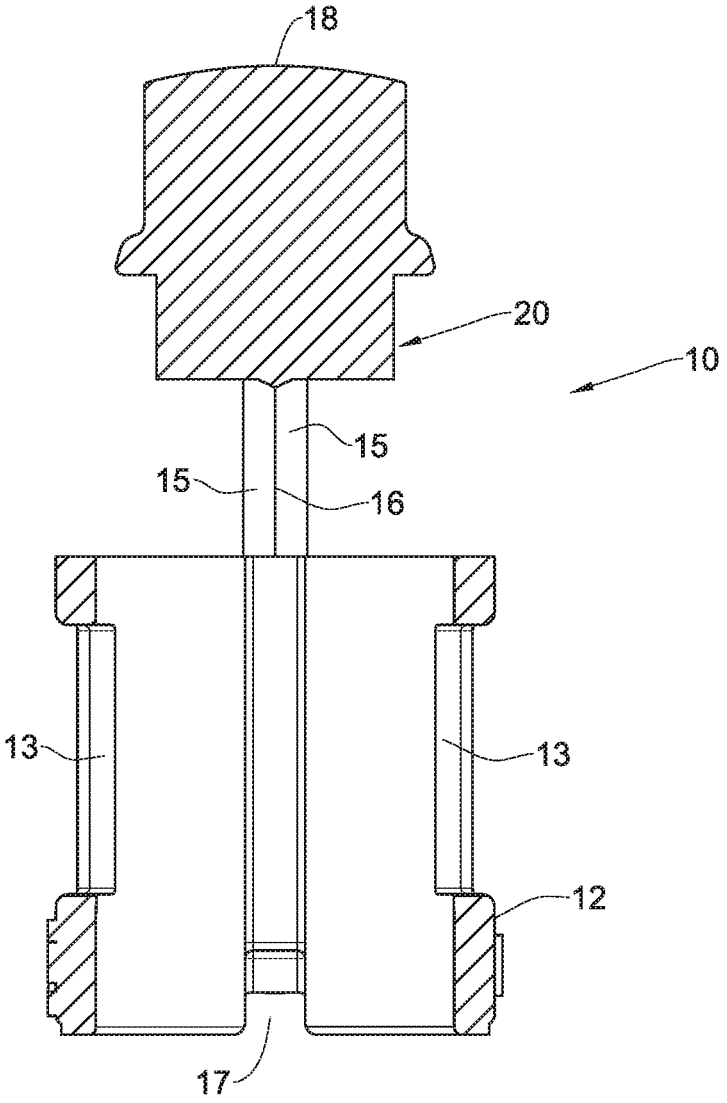
FIG. 2 is a longitudinal cross-sectional view of a sprayer bridge of the sprayer shown in FIG. 1B, taken along plane I-I.

Turning to FIGS. 1A and 1B, a sprayer is shown generally designated 1 and comprising a sprayer bridge 10 mounted over a sprayer housing 30 in a displaceable manner. The bridge 10 further comprises a dispersion element 20 configured for dispersing fluid emitted from the sprayer housing 30. The housing 30 further comprises an engagement arrangement 40 configured for allowing controlled displacement of the bridge 10 over the housing 30.

The sprayer housing 30 is constituted by a single injection molded body 32 having an inlet end 34 and an opposite outlet end 36 (shown in FIG. 3B) about which is elevated a protecting sleeve 36'. The inlet end 34 is configured for fixed attachment to a fluid source (a tank, a pipe etc.) via an attachment portion 33 having a dedicated thread 31.

The engagement arrangement 40 of the housing 30 comprises two lateral wings 42 which are inwardly depressible with respect to the housing body 32, each wing 42 comprising a snap-type latch 44 projecting outwardly from the housing body 32. The wings 42 are arranged diametrically opposite one another, i.e. disposed at 180° about a longitudinal axis X of the housing 32.

The engagement arrangement 40 further comprises two longitudinal guides 46, also diametrically opposed, but angularly spaced 90° from the wings 42. The guides 46 extend the majority of the length of the housing body 32 and are formed, at an end thereof closer to the fluid outlet 36 protected by the sleeve 36', with restricting projections 48, configured for restricting the movement of the bridge in a non-axial direction (i.e. limiting circular runout of the bridge).

In addition, it is noted that the housing further comprise two protrusions C configured for reducing the radial degree of freedom of the bridge over the housing, at least when in the open position thereof. Specifically, the protrusions C bridge the gap formed between the bridge 10 and the housing 30.

Figure 3A:
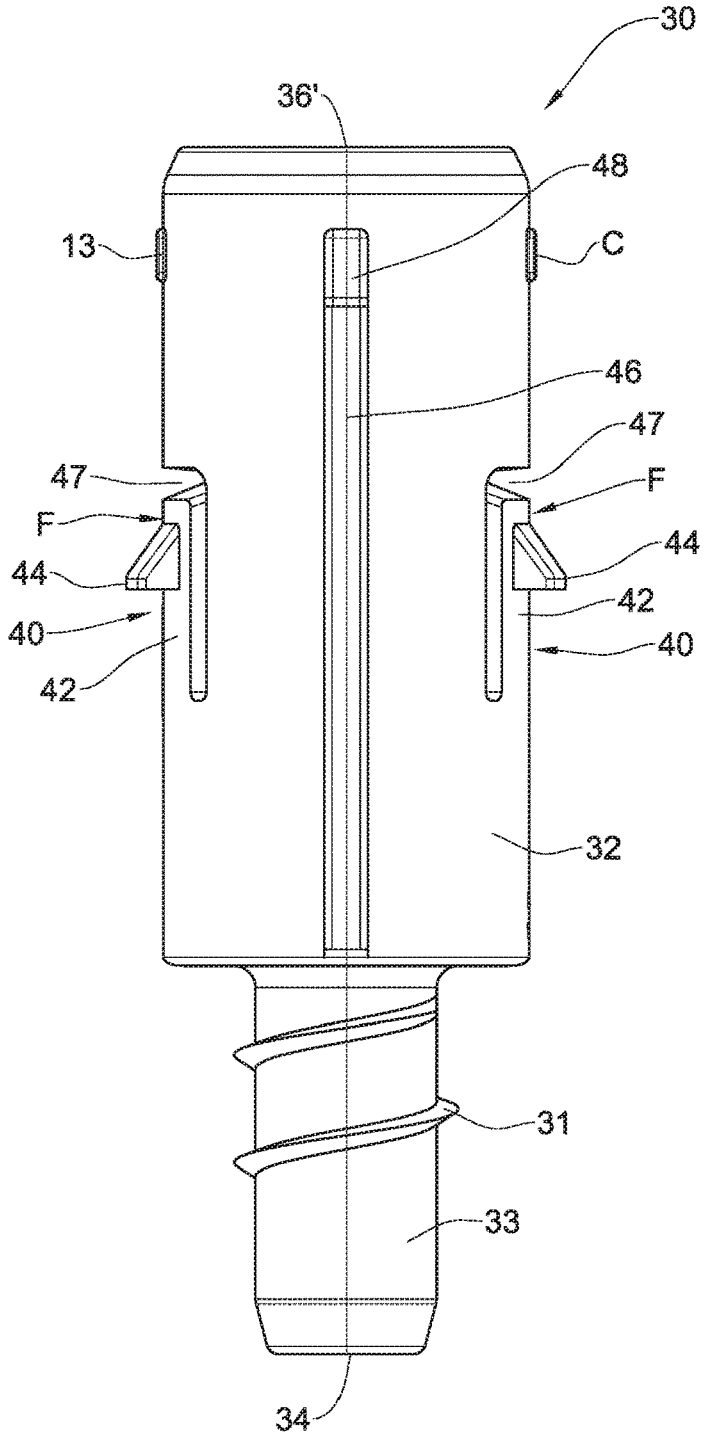
FIG. 3A is a schematic side view of a housing of the sprayer shown in FIGS. 1A to 2.
Figure 3B:
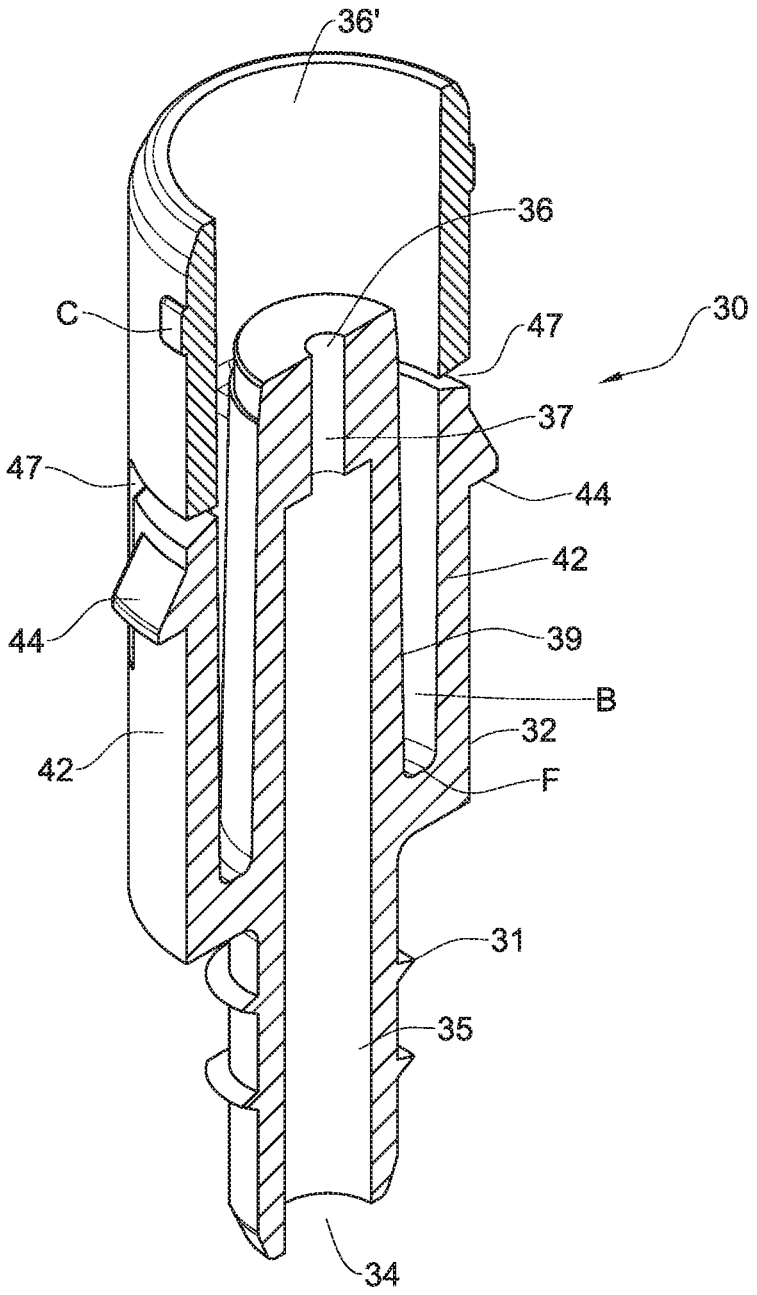
FIG. 3B is a schematic isometric cross-sectional view of the housing shown in FIG. 3A.

With additional reference being made to FIGS. 3A and 3B, the housing body 32 defines a hollow portion and accommodates therein an outlet nozzle 39 having an outlet channel 37. It is appreciated that the diameter of the channel 37 is considerably smaller than the diameter of a channel 35 leading thereto from the fluid inlet 34, the diameter being defined according to the desired flow-rate through the sprayer 1.

It is observed that there extends an annular basin B about the nozzle 39, configured for accumulating therein of clogging material (e.g. dirt, mud etc.). The arrangement is such that the basin floor F is located much lower than the outlet 36 of the nozzle 39, whereby such accumulated material does not block the nozzle 39.

In addition, it is appreciated that there are two slots 47 extending on both sides of the housing, configured, among other things, for drainage of accumulated material from the basin B. A top-most end of the slots 47 is also located below the level of the nozzle, outlet 36, so that material accumulated in the basin F can be drained from the housing before rising to a level blocking the nozzle 39.

The bridge 10 comprises a hollow mounting portion 12 configured for receiving therein the sprayer housing 32. The mounting portion 12 is formed with two diametrically opposed windows 13 configured for slidingly receiving therein the snap-type latches 44 of the engagement arrangement 40 and two diametrically opposed slots 17 configured for receiving therein the guides 46.

The bridge 10 comprises a round top structure constituted by two diametrically opposed arms 14 extending from the mounting portion 12 and meeting at a bridge head 18 elevated over the mounting portion 12. The dispersion element 20 is integrally formed with the bridge head 18 and disposed between it and the mounting portion 12.

It is also observed that each of the arms 14 is formed with two sloping surfaces 15 forming a dividing ridge 16 facing the central axis of the sprayer 1. In operation, the dividing ridge 16 serves to prevent obstruction of the fluid dispersed by the dispersion element 20.

Figure 4A:
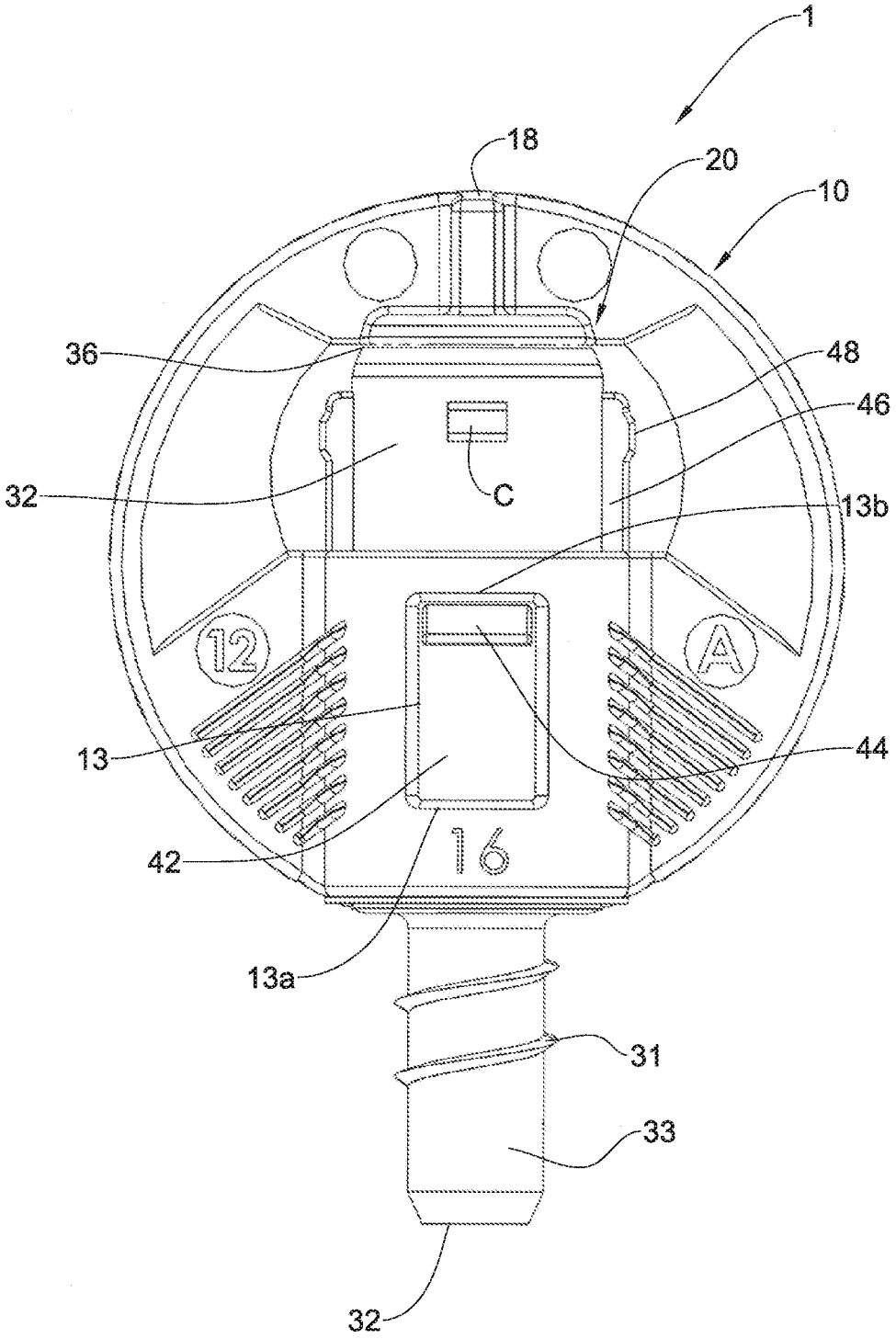
FIGS. 4A and 4B are schematic front views of the sprayer shown in FIGS. 1A to 2, in its respective open and closed positions.
Figure 4B:
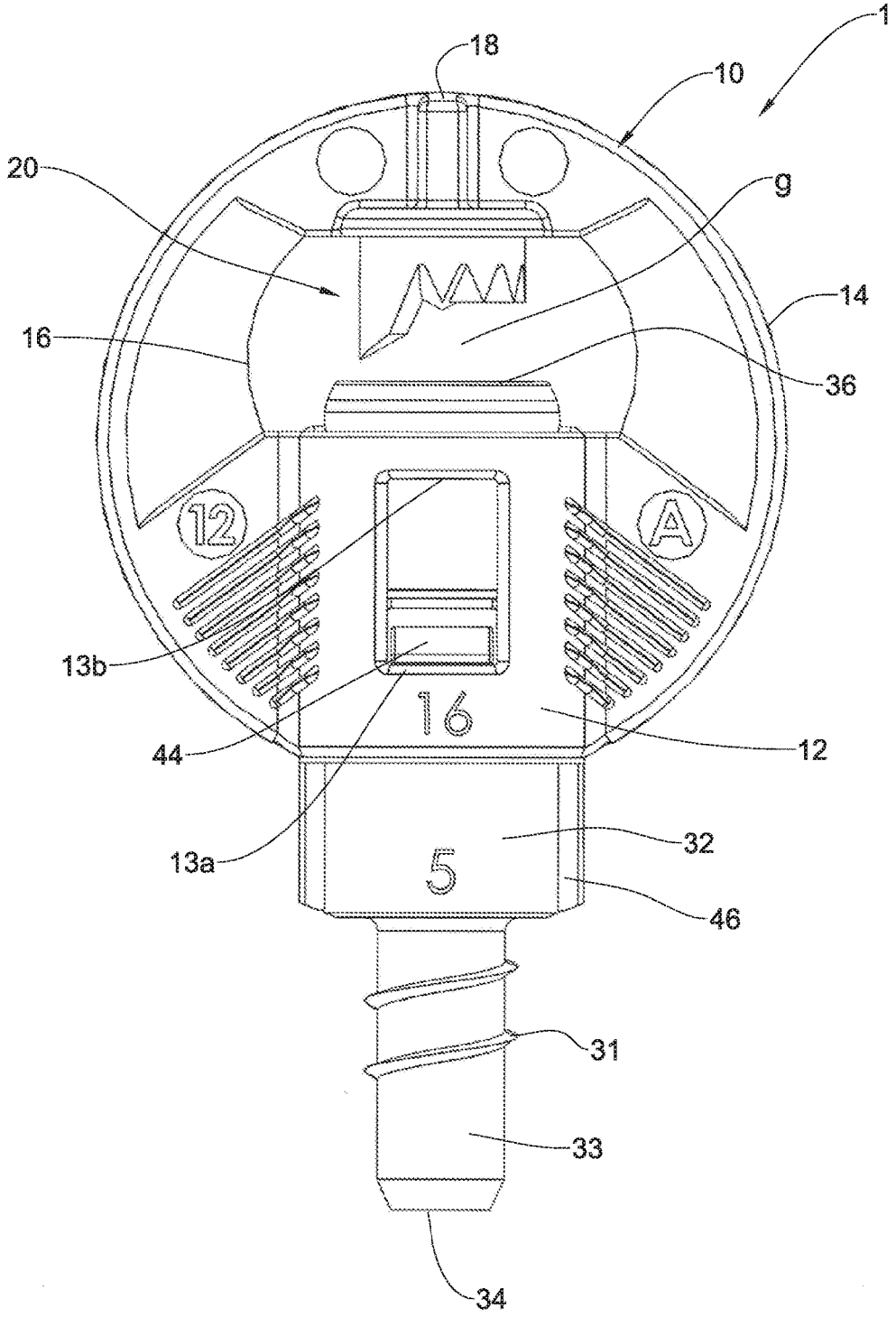

Turning now to FIGS. 4A and 4B, the sprayer 1 is shown attached to a fluid source B via the attachment portion 33. It is noted that this attachment is fixed (i.e. the housing 32 does not displace with respect to the source B at least during operation).

In the position shown in FIG. 4A, the sprayer 1 is in its closed position, the mounting portion 12 of the bridge 10 being received over a bottom portion of the housing body 32 so that the dispersion element 20 rests on the rim of the protecting sleeve 36', thereby sealing it. It is also noted that in the above position, the top end 13*b* of the window 13 is proximal to the latch 44. In the above position, fluid is not passed between the inlet 34 and the outlet 36, and the sleeve 36' is sealed, preventing dirt and insects from passing into the hollow portion of the housing body 32 (which may disrupt operation of the sprayer 1).

Turning now to FIG. 4B, in operation, fluid passed into the inlet 34 and emitted from the nozzle 37 as a fluid jet is emitted from the outlet 36 at sufficient pressure as to elevate the dispersion element 20 over the rim of the sleeve 36'. Under such pressure, the entire bridge 10 is displaced upwards so that there is formed a gap g between the dispersion element 20 and the sleeve 36'.

In this position, fluid emitted from the outlet 36 impacts the dispersion element 20 which then disperses the fluid jet by virtue of its geometric shape teeth 24 arranged about the dispersion element body 22. It is also noted that fluid is dispersed from the dispersion element 20 in a radially outwards direction, whereby the shape of the arm 14 and in particular the dividing ridge 16 prevent obstruction of the emitted fluid.

It is also noted that the sprayer 1 is a directional sprayer which is designed to disperse fluid in only a predetermined sector. Specifically in the described example, the dispersion element teeth 24 cover only about 270° (and not the entire 360°), However, it is appreciated that a plurality of dispersion elements can be contemplated, each having a different dispersion profile based on specific irrigation requirements.

In the open position shown in FIG. 4B, the force of the fluid pushes the bridge upwards but its movement is restricted by the latches 44 of the wings 42. In particular, in the open position, the bottom portion 13*a* of the window 13 abuts the latches 44, which prevent further upward displacement of the bridge 10.

Once fluid flow is ceased, the force on the dispersion element 20 drops, whereby the entire bridge 10 falls back to its closed position (shown in FIG. 4A), by virtue of gravitational forces.

It is noted that in both the closed and open positions, shown in FIGS. 4A and 4B, the fluid inlet 34 remains fixed and the distance of the fluid outlet 36 does not vary with respect to the fluid inlet 34. To the contrary, the mobile part of the sprayer 1 is the bridge 10 and not the fluid outlet 36.

Figure 5A:
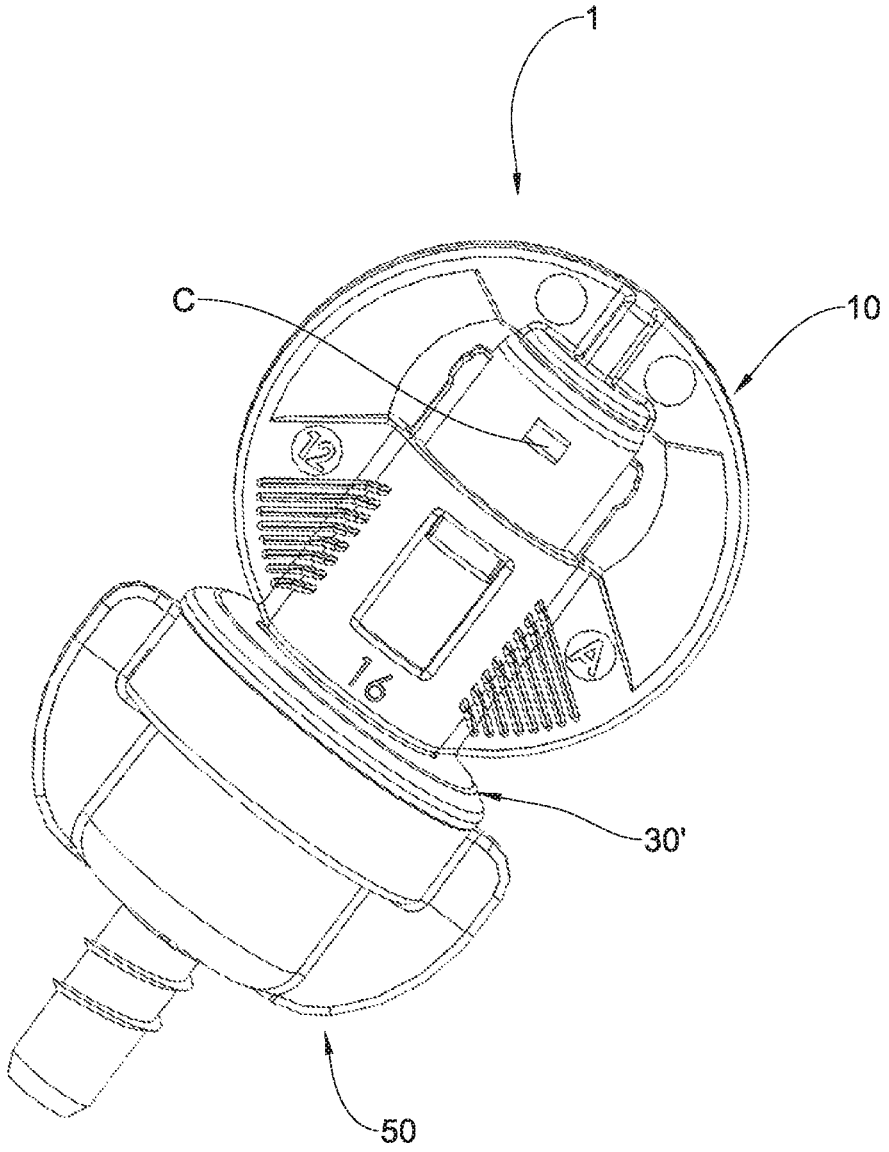
FIG. 5A is a schematic isometric view of a sprayer according to another example of the subject matter of the present application.
Figure 5B:
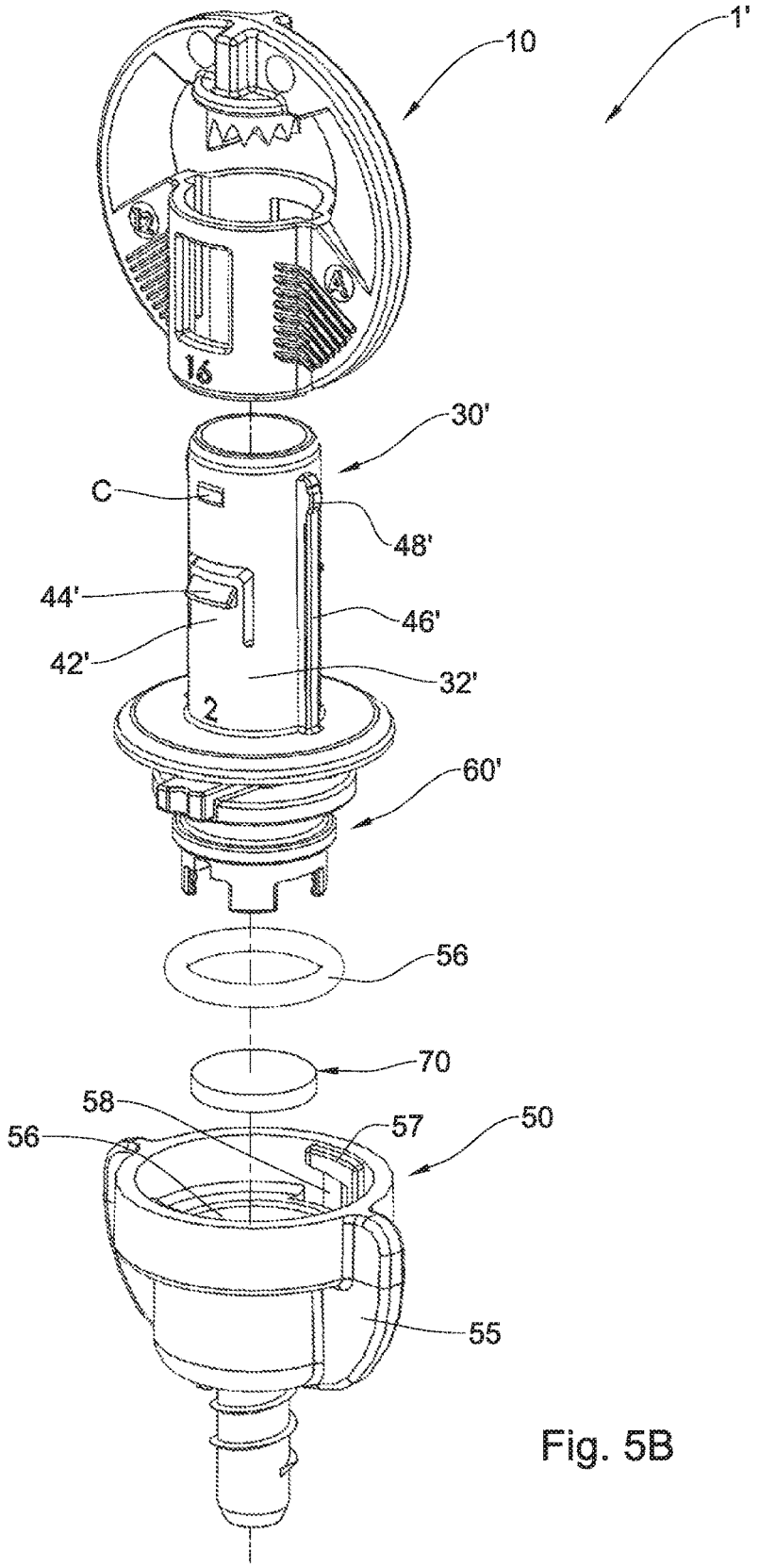
FIG. 5B is a schematic exploded isometric view of the sprayer shown in FIG. 5A.

Turning now to FIGS. 5A and 5B, another example of a sprayer is shown, generally designated 1'. Under this design, the sprayer 1' comprises a similar bridge 10, but a modified housing 30' which is configured for articulation to an additional member 50 and comprising a flow-rate regulator 60.

Under this arrangement, the housing 30' comprises the sleeve 36" and the additional member 50 comprises the fluid inlet 54 which is configured for fixed attachment to a fluid source.

Figure 6:
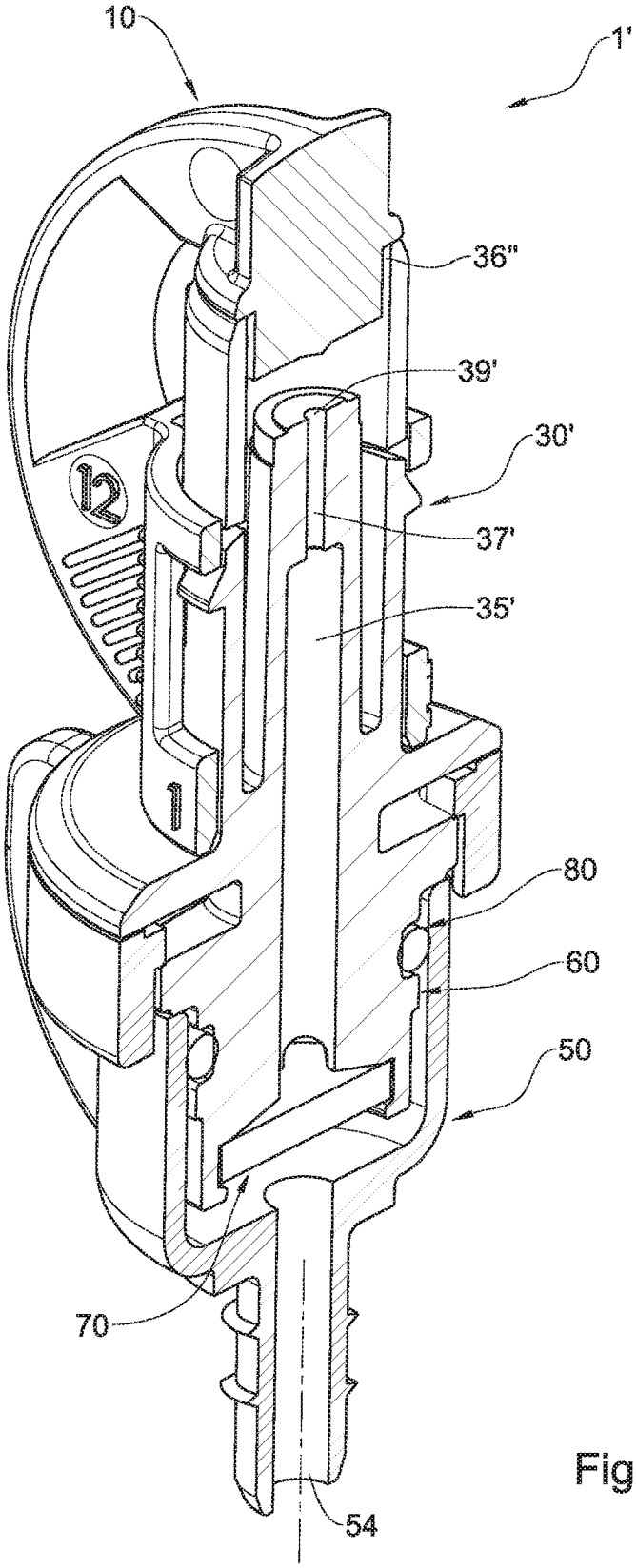
FIG. 6 is a longitudinal cross-sectional view of the sprayer shown in FIGS. 5A and 5B, taken along plane B in FIG. 7A.
Figure 7A:
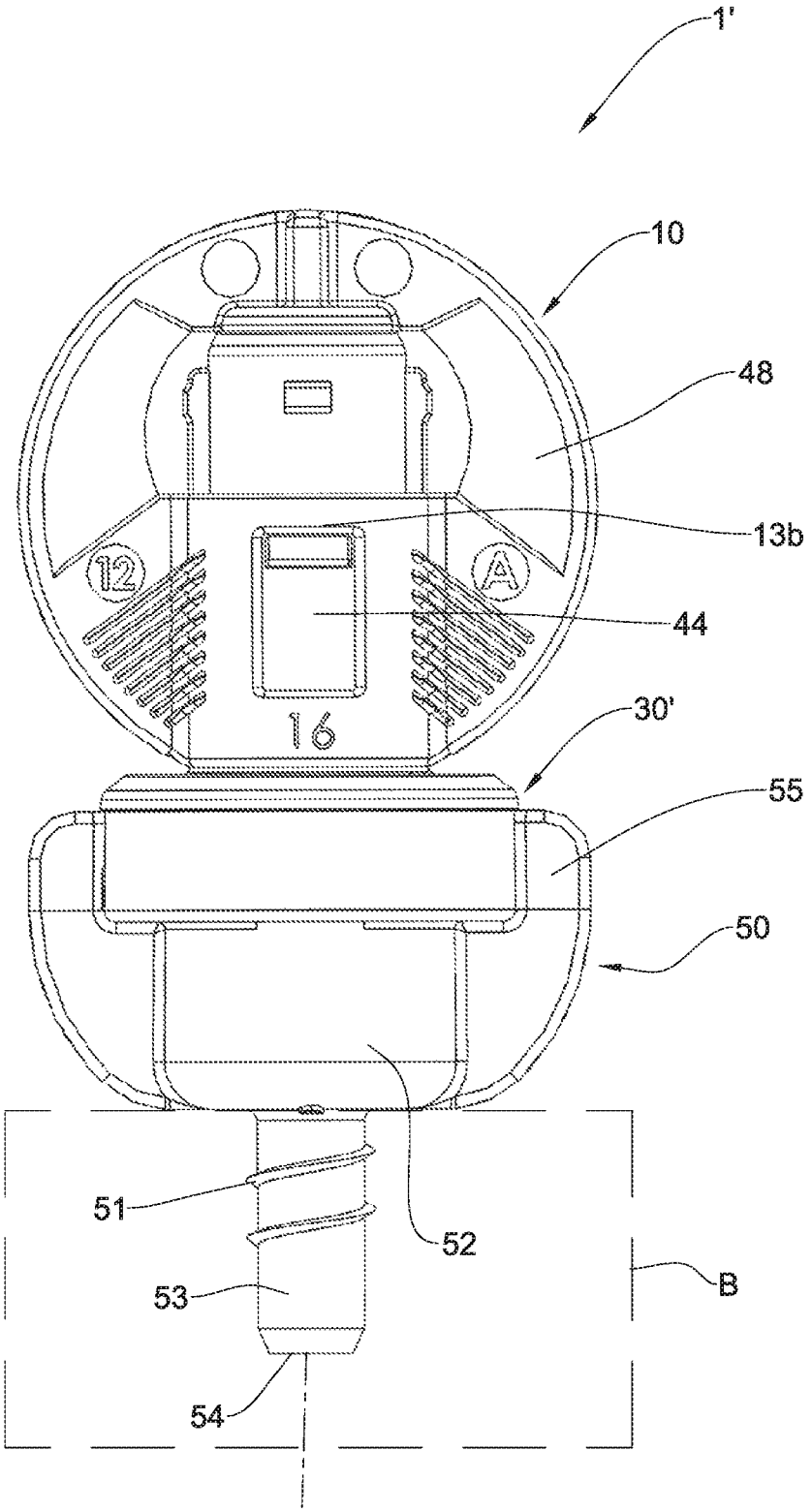
FIGS. 7A and 7B are schematic front views of the sprayer shown in FIGS. 5A to 6, in its respective open and closed positions.
Figure 7B:
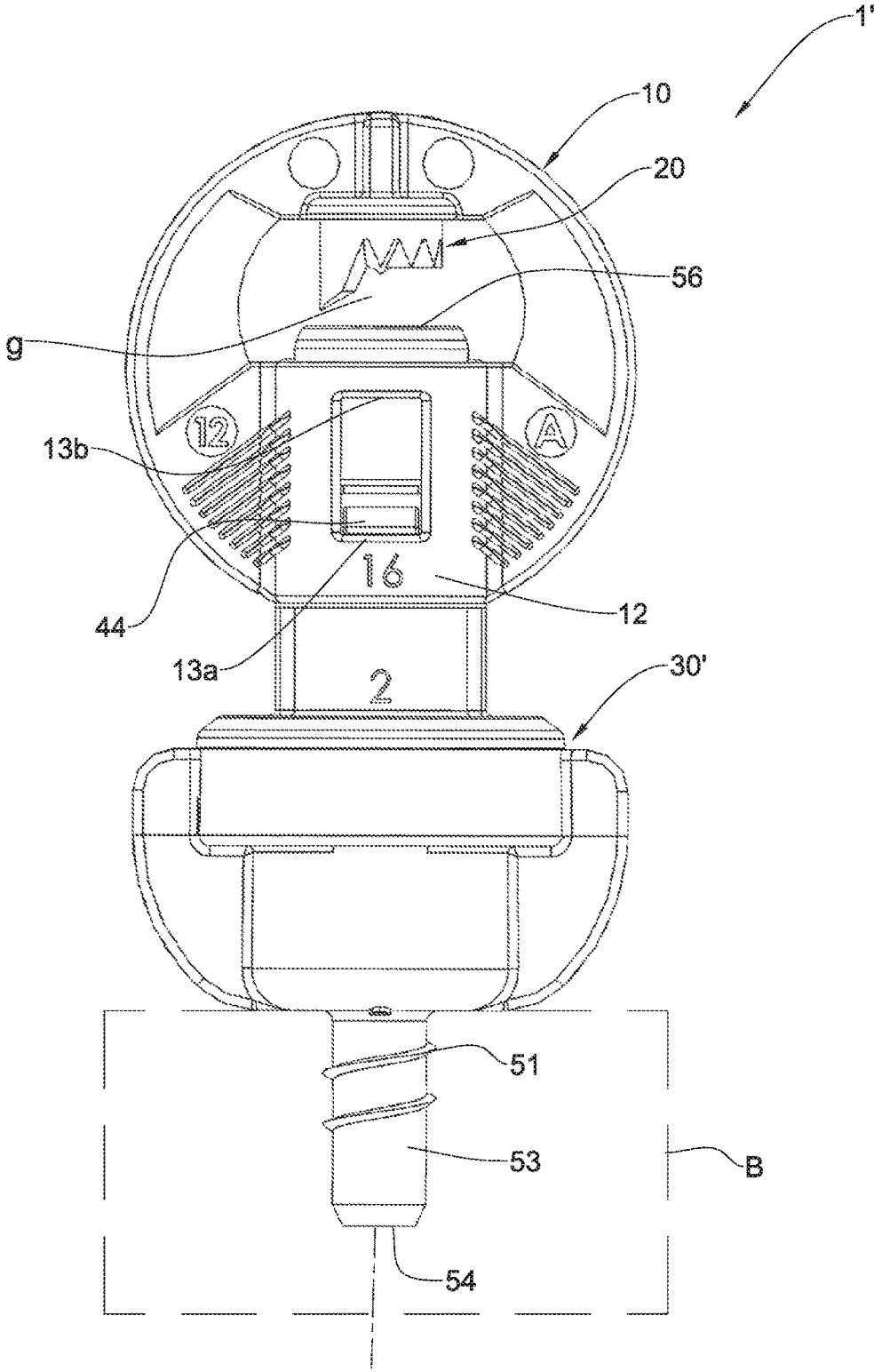

A bottom portion of the housing 30' is formed with a flow-rate regulator structure 60 configured for accommodating a sealing ring 80 and a diaphragm 70, for the purpose of regulating fluid flow from the inlet 54 to the outlet 39', as shown in FIG. 6.

The operation of the sprayer 1' is essentially identical to the operation of sprayer 1, with the difference being in the structure of the housing 30'. In particular, in this case as well, the fluid inlet 54 remains in fixed attachment to the source via its connecting portion 53, and the distance between the fluid inlet 54 and the fluid outlet 39' remains fixed.

Figure 8A:
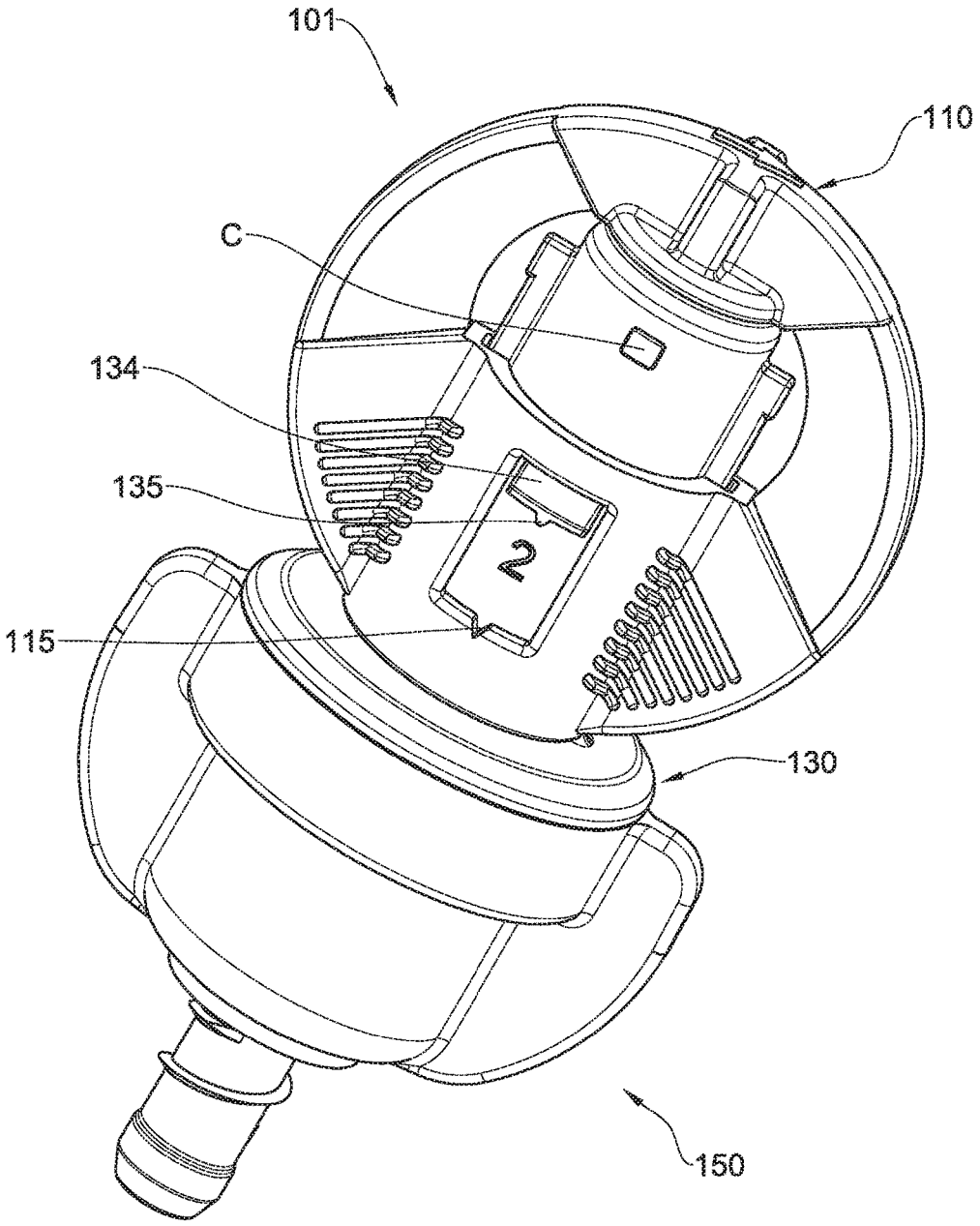
FIG. 8A is a schematic isometric view of a sprayer according to another example of the present application.
Figure 8B:
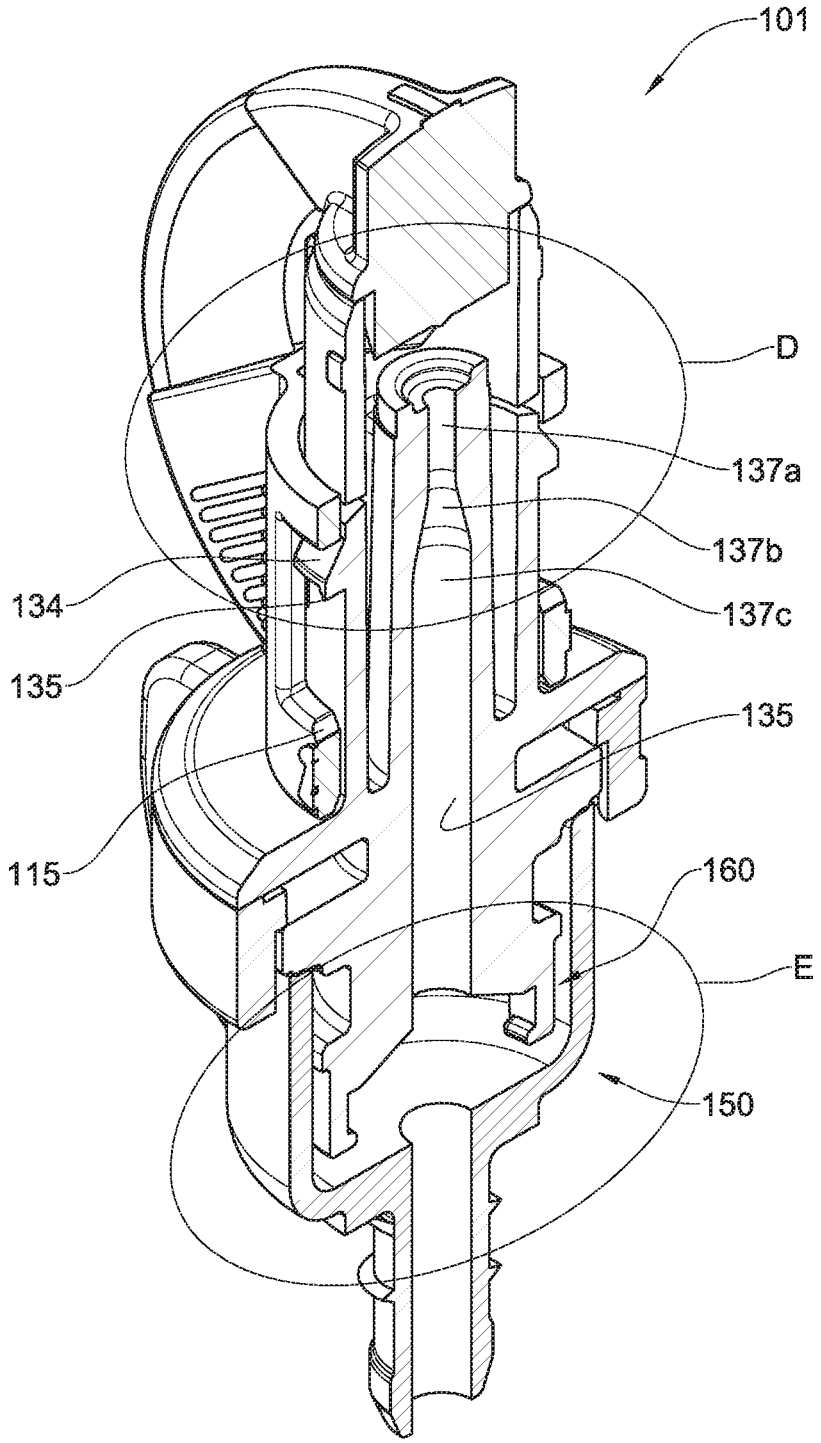
FIG. 8B is a schematic longitudinal cross-section view of the sprayer shown in FIG. 8A.
Figure 8C:
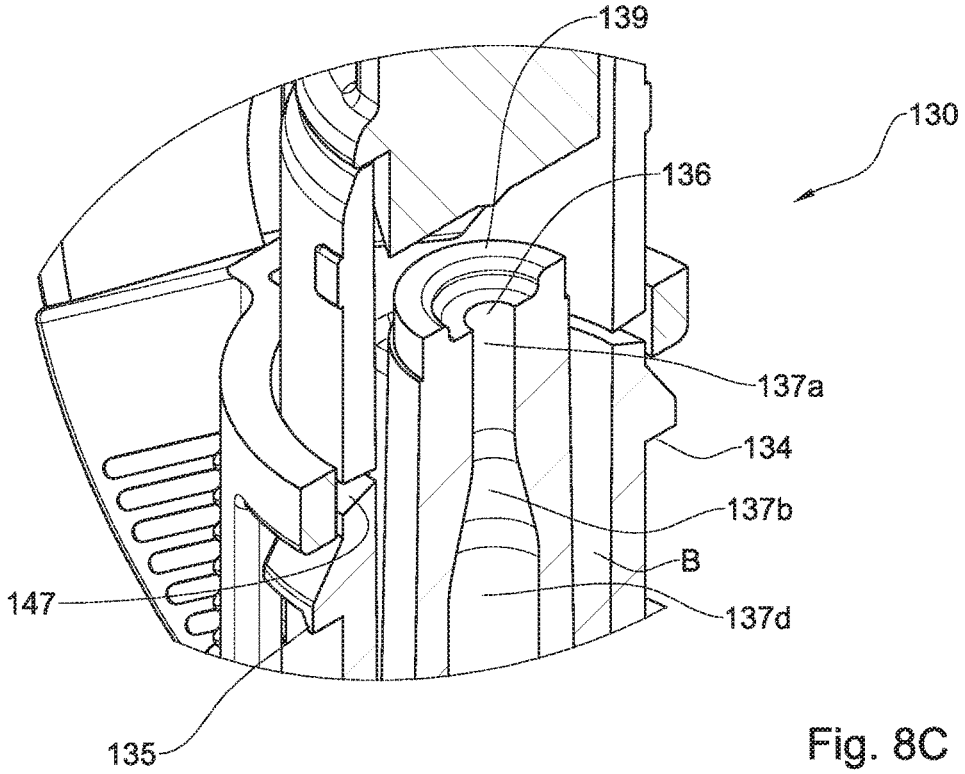
FIGS. 8C and 8D are schematic enlarged views of details D and E shown in FIG. 8B.
Figure 8D:
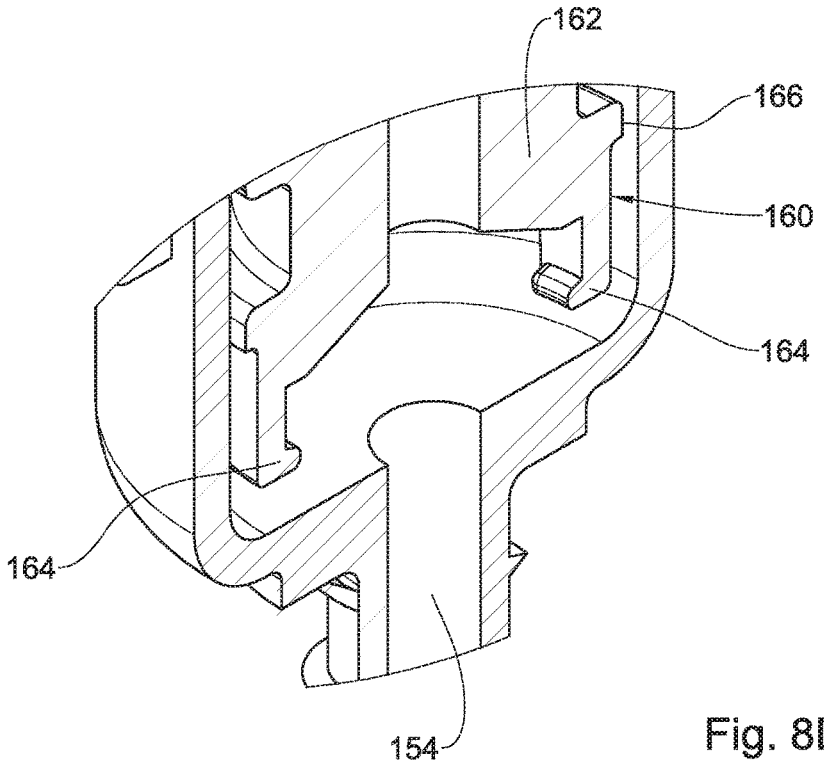
Figure 8E:
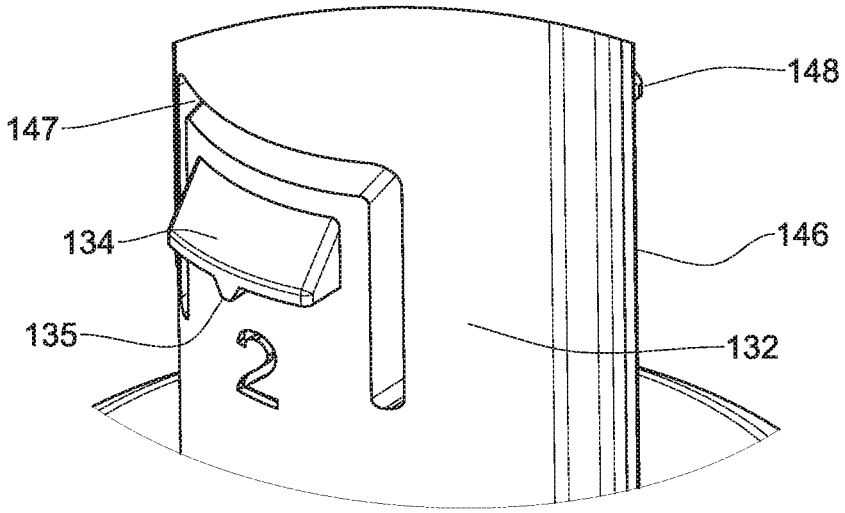
FIG. 8E is a schematic enlarged view of a latch member of the sprayer shown in FIG. 8A.
Figure 9:
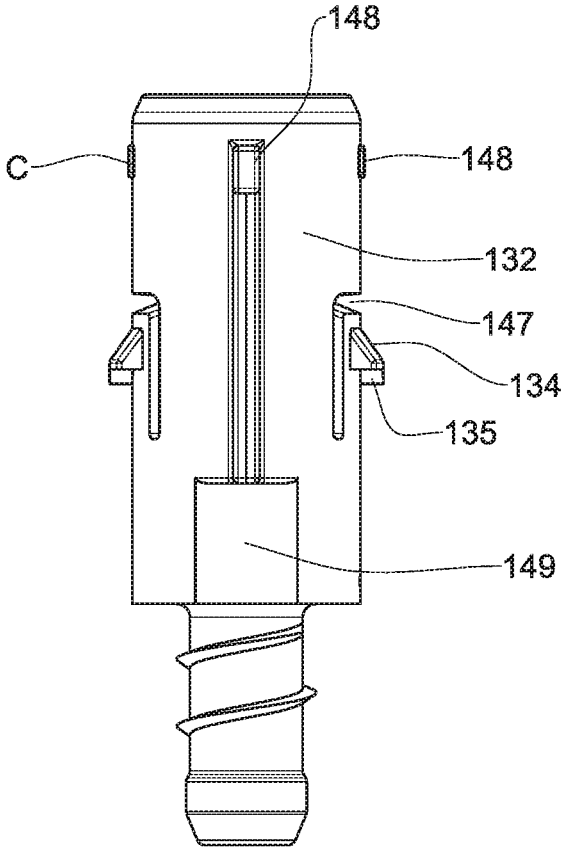
FIG. 9 is a schematic side view of the irrigation member of the sprayer shown in FIGS. 8A to 8E.

Turning now to FIGS. 8A to 9, another embodiment of a sprayer is shown, generally designated 101, and which is similar to the previously described sprayer 1'. Elements of sprayer 101 similar to those of sprayer 1' are designated by the same reference numbers, upped by a 100, so that element 132 of sprayer 101 is similar to element 32' of sprayer 1' etc.

The sprayer 101 differs from the sprayer 1' by the design of several elements as will be described below.

First of all, the nozzle is not in the form of a straight channel (as nozzle 37'), and now comprises three segments: a top straight segment 137*a* of a small diameter, a conical/tapering segment 137*b* and a bottom straight segment 137*c*, thereby defining a tapering shape of the nozzle. Using a diverging design of the nozzle can facilitate better emission of fluid from the sprayer and more convenient control over the pressure of the irrigation fluid within the nozzle.

Secondly, the latch 134 is provided with a projection 135 which is configured for being received within a corresponding nook 115 of the bridge member 110. Engagement between the projection 135 and nook 115 facilitates restricting the spray member 130 from performing a tilting movement about the longitudinal axis of the sprayer 101.

Furthermore, with particular reference being made to FIG. 9, it is noted that one of the guide members 148 of the sprayer is provided with a flat portion 149 configured for providing a more efficient plastic molding process when manufacturing the sprayer. In particular, this flat portion 149 is formed by a piece of the mold allowing more convenient injection of the molten plastic during injection molding.

Another difference between the sprayer 101 and the sprayer 1' lies in the configuration of the bottom portion 162 of element 160 which is configured for holding the diaphragm in place. Under the present design, the bottom portion 162 comprises legs 164 circumferentially spaced about the central axis of the sprayer and configured for retaining therein the diaphragm.

Those skilled in the art to which this invention pertains will readily appreciate that numerous changes, variations, and modifications can be made without departing from the scope of the invention, mutatis mutandis.

The invention claimed is:

1. A sprayer comprising:

a housing having a fluid inlet statically coupled to a fluid source to receive fluid therefrom under pressure and a fluid outlet discharging said fluid, the distance between said fluid inlet and said fluid outlet being fixed;

a bridge mounted over the housing and comprising:

a dispersion element dispersing fluid discharged from the fluid outlet of the housing; wherein the dispersion element is integrally formed with the bridge;

a mounting portion displaceably fitted over the housing at a location circumferentially outside of the housing; and at least one arm extending upwardly from the mounting portion and mounting the dispersion element to the mounting portion, the bridge displaceable over the housing at least between a closed position in which the dispersion element prevents access of foreign matter to the fluid outlet, and an open position in which the dispersion element is spaced from the fluid outlet by a gap, allowing dispersion of the fluid;

an open limiter configured for restricting displacement of the bridge over the housing beyond the open position by limiting a traveling distance between the dispersion element and the fluid outlet so as not to exceed an operational gap; and a closed limiter, configured, in the closed position, for preventing displacement of the bridge over the housing beyond the closed position, the open limiter and the closed limiter being constituted by an engagement between the housing and the mounting portion of the bridge, the bridge and the housing together including a channel, having a first end and a second end, and a restricting member configured for being received within the channel and displaced therein, wherein the restricting member is at least one restricting projection;

wherein displacement at the open position is limited by engagement of the restricting member with the first end of the channel and displacement at the closed position is limited by engagement of the restricting member with the second end of the channel.

2. A sprayer according to claim 1, wherein, in operation, the housing forms a unitary body in which the fluid outlet is stationary with respect to the fluid inlet.

3. A sprayer according to claim 2, wherein the housing is constituted by a single piece unit having one end constituting the fluid inlet and an opposite end constituting the fluid outlet.

4. A sprayer according to claim 1, wherein the bridge is constantly urged into the closed position by a biasing force.

5. A sprayer according to claim 4, wherein displacement of the bridge from the closed position to the open position is facilitated by the pressure of the fluid emitted through the fluid outlet.

6. A sprayer according to claim 4, wherein the bridge is biased towards the closed position by virtue of gravitational forces.

7. A sprayer according to claim 6, wherein, in the open position, the bridge is elevated over the fluid outlet and is constantly urged downwards towards the fluid outlet.

8. A sprayer according to claim 7, wherein, in a given orientation of the housing, a vertical downwards gravitational vector provides the biasing force for biasing the bridge into the closed position.

9. A sprayer according to claim 1, wherein displacement of the bridge over the housing is facilitated by guides formed in the housing and the bridge and configured to engage one another to determine a displacement path of the bridge.

10. A sprayer according to claim 9, wherein the guides are generally straight, whereby displacement of the bridge over the housing is performed linearly.

11. A sprayer according to claim 1, wherein the open limiter prevents the bridge from disengaging from the housing due to displacement away from the fluid outlet.

12. A sprayer according to claim 1, wherein the fluid outlet itself serves as the closed limiter.

13. A sprayer according to claim 1, wherein the at least one arm is formed with a dividing edge facing said fluid outlet.

14. A sprayer according to claim 1, wherein the housing comprises a sleeve portion having an open end delimited by a rim constituting the fluid outlet of the housing, and a nozzle having a nozzle outlet disposed at or below a level of the rim.

15. A sprayer according to claim 14, wherein, in the closed position of the sprayer, the rim of the sleeve portion is sealed by the dispersing element while the nozzle is located within the sleeve portion.

16. A sprayer according to claim 14, wherein the sleeve portion has a diameter greater than that of the nozzle, thereby yielding an annular basin extending about the nozzle.

17. A sprayer according to claim 16, wherein the basin has a bottom surface disposed below a level of the nozzle outlet, whereby dirt, mud and clogging material is accumulated within the basin, around the nozzle, without blocking the nozzle outlet.

18. A sprayer according to claim 17, wherein the sleeve portion is provided with at least one drainage opening configured for draining the dirt, mud and clogging material from the basin.

19. A sprayer according to claim 18, wherein the at least one drainage opening is located below the level of the nozzle outlet.

* * * * *